United States Patent [19]

Harn

[11] Patent Number: 4,635,667

[45] Date of Patent: Jan. 13, 1987

[54] SUN PROTECTION CANOPY

[76] Inventor: James E. Harn, P.O. Box 345, Richmond Hill, Ga. 31324

[21] Appl. No.: 714,985

[22] Filed: Mar. 22, 1985

[51] Int. Cl.[4] ..... E04H 15/04; A47C 7/10; F16B 7/10; E05C 17/64

[52] U.S. Cl. ..... 135/90; 297/184; 403/83; 16/339

[58] Field of Search ..... 135/90, 117; 297/184, 297/373; 403/83, 97, 84, 91; 16/339, 340

[56] References Cited

U.S. PATENT DOCUMENTS

| | | | |
|---|---|---|---|
| 2,346,364 | 4/1944 | Dowe | 403/84 X |
| 2,502,103 | 3/1950 | Puls | 135/101 |
| 2,512,806 | 6/1950 | Neiborn | 297/184 |
| 3,162,206 | 12/1964 | Betts | 297/184 X |
| 3,362,747 | 1/1968 | Fuelling et al. | 297/373 |
| 4,201,416 | 5/1980 | Vanderminden | 297/184 |

FOREIGN PATENT DOCUMENTS

| | | | |
|---|---|---|---|
| 93591 | 9/1962 | Denmark | 297/184 |
| 849478 | 9/1952 | Fed. Rep. of Germany | 297/373 |
| 310120 | 12/1955 | Switzerland | 297/373 |

*Primary Examiner*—Robert A. Hafer
*Assistant Examiner*—D. Neal Muir
*Attorney, Agent, or Firm*—Roland H. Shubert

[57] ABSTRACT

A canopy provides sun protection for the occupant of a recreational chair. The canopy is slidably mountable on the chair back and can be positioned immediately to any desired angle by simple but effective tension applying means.

7 Claims, 4 Drawing Figures

SUN PROTECTION CANOPY

BACKGROUND OF THE INVENTION

This invention relates generally to a canopy fittable to a recreational chair such as a foldable, beach or deck chair.

Protection from the sun for the occupants of recreational chairs, such as beach or deck chairs, through the use of canopies or awnings has long been known. Such canopies may be an integral part of the chair, or be attachable or detachable at will. Where the canopy is an integral part of the chair, problems of chair storage in compact form, ease of transportation and lack of flexibility arise. Where the canopy is attachable and detachable, the use of bolts, nuts, rachets, and the like, and special tools to manipulate the same, are generally required. This leads to difficult and time-consuming operations for the attachment and detachment of the canopy.

For example, the Borichevsky U.S. Pat. No. 4,230,363 shows a canopy mounted on the backrest portion of a furniture frame through a clamp and bolt arrangement. This arrangement is not readily adaptable for use with many common types of furniture frames.

Another approach to providing a canopy-like sun protection device is taken by Staroste et al. in U.S. Pat. No. 4,093,305. Patentees provide at least two frame-type supporting beams which are commonly pivoted at their bases through a bolt attached to a bracket which in turn is clamped to the chair side. The frame-type supporting beams separate and carry awning material to provide a sun shade.

Other awnings or sun shades adapted for use with various types of recreational chairs are shown in U.S. Pat. Nos. 3,738,703; 3,243,230; 1,919,110; 900,572 and 798,823.

SUMMARY OF THE INVENTION

The invention provides a canopy, or awning, so constructed as to fit onto the back-rest of an existing recreational chair without modification of the chair frame. The canopy can be easily adjusted so that the chair occupant gains relief from the rays of the sun. The canopy, being readily adjustable in its angle of position provides any quantum of protection from the sun that the occupant may desire and is adapted to rotate to an essentially parallel position with either the front or back of the chair backrest allowing for compact folding of the chair with the canopy attached thereto.

Hence, it is an object of this invention to provide a sun-screening canopy easily attachable to standard recreational beach and deck furniture.

Another object of this invention is to provide a canopy attachable to a folding chair or lounge which does not interfere with the folding and transport of the furniture.

BRIEF DESCRIPTION OF THE DRAWINGS

In the various figures, like numerals designate the same part.

DESCRIPTION OF PREFERRED EMBODIMENTS

Preferred embodiments of this invention generally include two members, or legs, of the canopy which attach to the chair back support, or backrest, are of pipe or tubular construction and are slotted on their facing surfaces so that the legs may slide over, and be in snug relationship with, the back support member of the chair frame. A cross member, also of tubular construction, contacts but does not attach to, the two slotted legs at their ends opposite the slots, and a rod extends therethrough. The rod is threaded on at least one end and the threaded end extends through the wall of a leg member so that it can mate with a threaded cap which can be rotated at will. The opposite end of the rod is attached, or fastened, to the upper end of the other leg members as by bending the rod to extend into the other leg member. On applying tension on the rod by tightening the tension cap, the bent portion of the rod firmly by contact, grips the leg member and is thereby attached through the pressure, or tension applied. By tightening the threaded cap, the two leg members connected by the connecting member are forced against the ends of the connecting member and the connecting member is then held in any desired position. The connecting member is attached near its ends to two arm members extending outwardly therefrom in the same plane, the outwardly extending arm members terminating by attachment to a cross arm member, said outwardly extending arm members and said cross arm member forming a frame on which shading material such as plastic sheet or cloth is attached. The cross arm member and the two arm members can be constructed by bending arm construction material into a "U" shape so that the single piece forms the two arm members and the cross arm member and may be used to carry the shading material, or together with the connecting member attached to the two arms of the "U", form a frame to which the shading material may be attached. Since the frame is attached to the connecting member, when the connecting member is rotated, the frame is rotated and its end away from the connecting member is raised or lowered, the ease of rotation being adjusted by turning the threaded cap.

Polyvinyl chloride (PVC) which has been stabilized against deterioration by light, and especially against radiation from the sun, is the preferred material of construction for the framing arm members, but other materials such as polypropylene or aluminum may be used. Pipelike, or tubular, materials of construction are required for certain members as herein described, but for other members solid or rod-like materials may be used.

Figure 1:
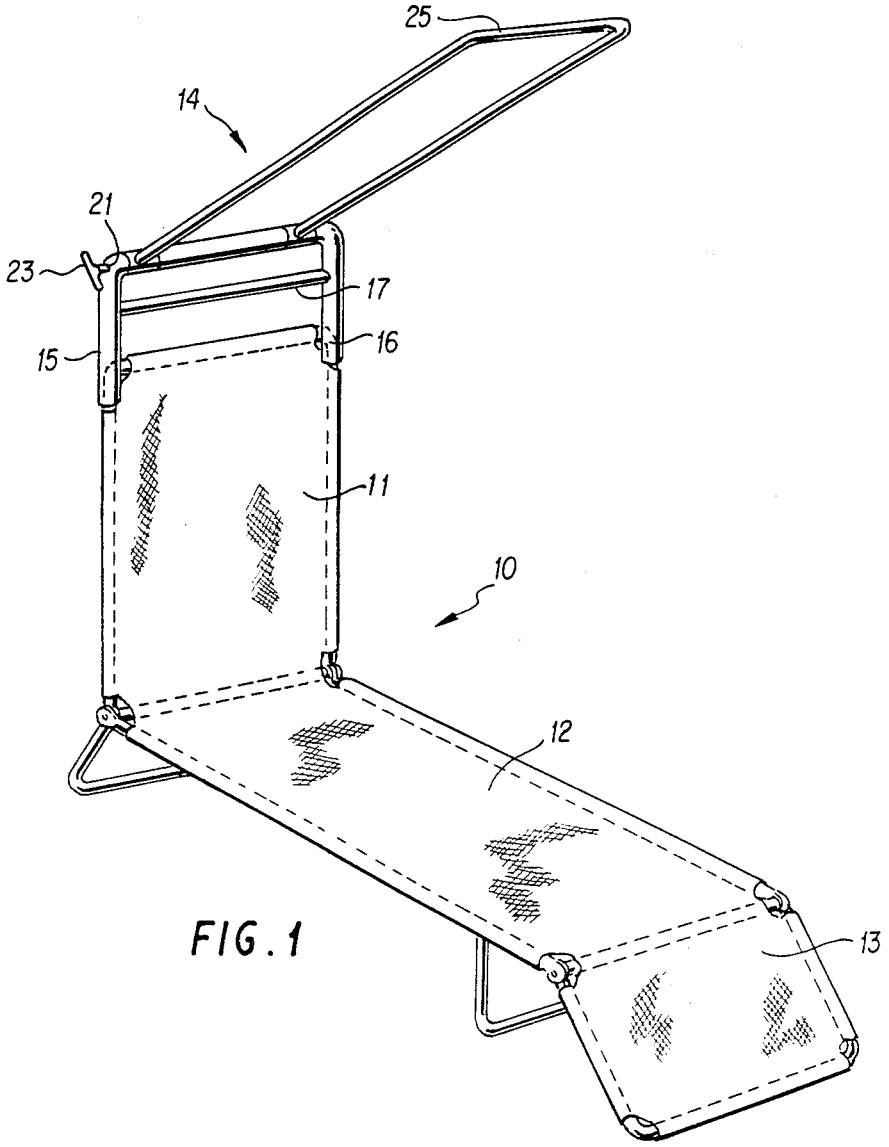
FIG. 1 is a perspective view of a recreational chair having the canopy of the invention mounted thereon.

Referring to a specific embodiment of the invention as depicted in FIG. 1, there is shown a recreational chair 10 with the canopy of this invention mounted thereon. Chair 10 is of conventional type having a back portion 11, a seat area 12 and a leg-rest 13 hingably connected so that the chair may be folded for ease of carrying and transport. Canopy 14 of this invention is mounted at the top of chair back 11.

Figure 2:
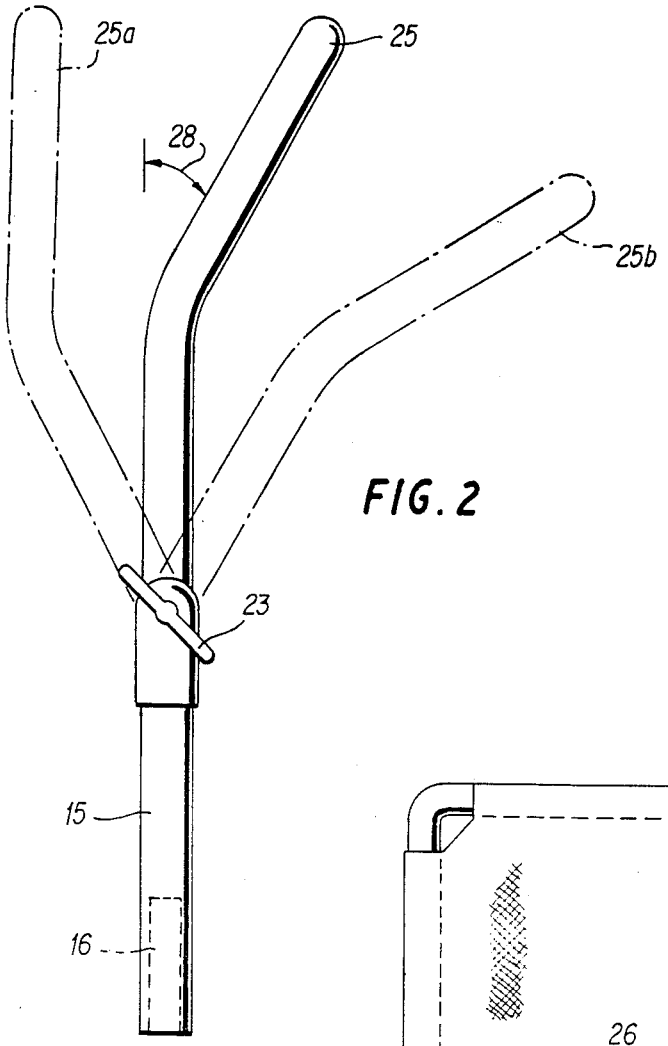
FIG. 2 is a side view of the canopy.
Figure 3:
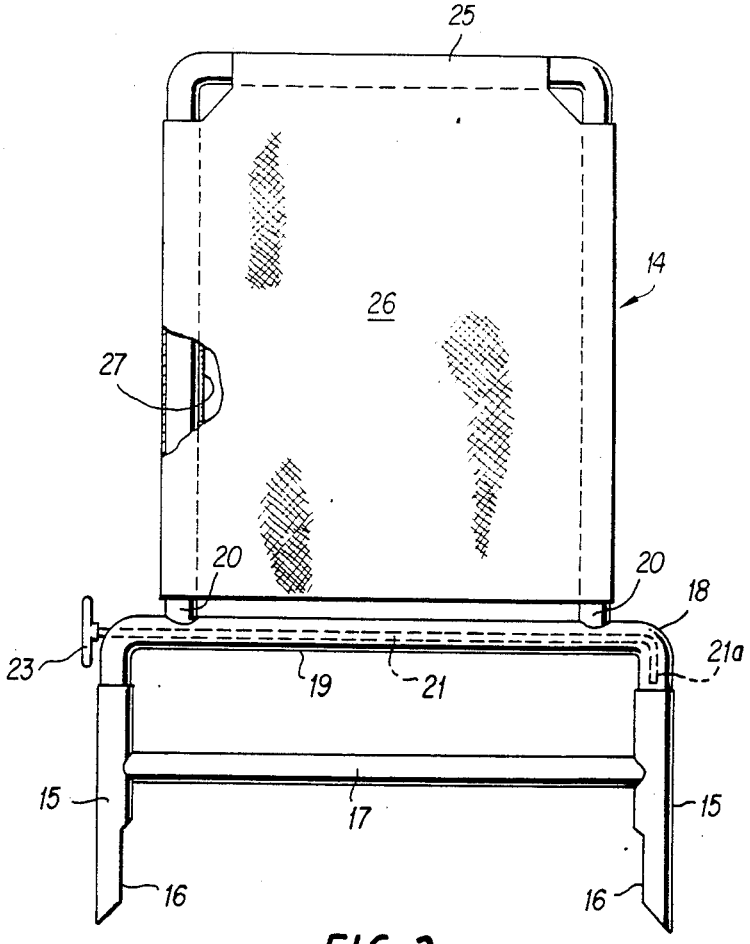
FIG. 3 is a front view of the canopy.

Details of the canopy construction are more clearly illustrated by reference to FIGS. 2 and 3 in conjunction with FIG. 1 wherein like reference numerals refer to the same or equivalent elements in each drawing figure. Canopy 14 includes a pair of mounting leg members 15 having cutaway portions forming slots 16 at their lower ends. Members 15 are of tubular or pipe construction having an inside diameter sized to fit edges of the chair back support 11. Leg members 15 are held in a fixed and rigid attitude spaced apart a distance equal to the width of the chair back 11 by means of support bar 17. Each leg member 15 terminates at its upper end in an inwardly pointing end piece 18 of generally ell shape. Disposed between the two inwardly pointing end pieces 18 is a tubular connecting member 19 with tee-shaped canopy frame base members 20 rotatably positioned between each end piece 18 and connecting member 19.

Base members 20 are frictionally rotatable relative to each end piece 18 and are arranged to be locked or fixed at any position over a large arc. In one embodiment, the locking means may comprise a rod 21 extending axially through tubular connecting member 19. Rod 21 has threads 22 of a length sufficient to extend through the end of member 19 and end piece 18, and has threaded tension cap 23 mated therewith. The opposite end of rod 21 bends downwardly into leg 15 as shown at 21*a* so that when cap 23 is rotated to increase the tension on rod 21, bent end 21*a* is forced against end piece 18 of leg 15 by being drawn toward cap 23; bent end 21*a* is thereby attached by pressure to leg member 15.

Figure 4:
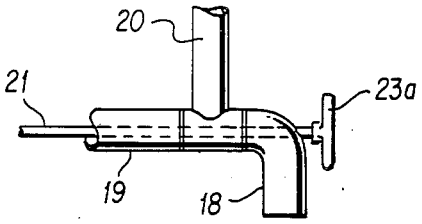
FIG. 4 illustrates a modified embodiment of means for applying tension to position the canopy.

FIG. 4 shows another embodiment for attaching rod 21 to the end opposite tension cap 23. In this embodiment rod 21 is threaded on both ends and the threaded ends each extend through connecting member 19 and through end pieces 18. Tension caps 23 and 23*a* are each mated to a threaded end of rod 21. This embodiment supplies two tension caps and either or both simultaneously can be used to position the canopy 14. Also, instead of tension cap 23*a*, a threaded lock nut or cap (not shown) can be used to anchor rod 21 at the end opposite tension handle 23, as can other anchor means so long as rod 21 does not significantly rotate as tension cap 23 is rotated.

Canopy 14 itself may comprise a U-shaped frame member 25, the two ends of the U member fitting into and being attached to the canopy frame base members 20. The stability of position and ease of rotation of frame 25 is regulated by tension handle 23. Frame 26 may rotate to touch either the front or back of the chair back rest, which provides for compact folding of the chair with the canopy attached thereto. As is best shown in FIG. 2, frame 25 is preferably bent downwardly near its center at an small angle 28, preferably on the order of about 30 degrees from the horizontal. Alternatively, frame 25 may be bent in the form of a gentle, continuous arc. Tension cap 23 allows rotational movement of frame 25 and locks the frame into any desired position such as is shown in dotted outline at 25*a* and 25*b*.

A light screening material 26, preferably of fabric form, is disposed over frame 25. The screening material 26 may be fabricated in sleeve-like form to slip over frame 25. Alternatively, the screening material may be attached to the canopy frame by any convenient means, such as by sewing, zippers, or snaps. It is preferred to have the screening material attached by means which permit changing or replacement. Conveniently the material will carry an adhesive or adhesive means 27 at least along its edges so that it will grip the canopy frame on contact, and be detachable at will. The material may also attach to connecting member 19. Materials of different colors and appearances may be substituted on the canopy frame. Mesh screen material of a plastic such as nylon, polyethylene, polypropylene, or the like can be used. A mesh screen material is preferred as admitting a minor amount of sun rays which can be largely controlled by adjusting the angle of the canopy. Parachute material and the like may be used. Emblems, logos, trademarks, advertising, and the like may be displayed on the canopy.

I claim:

1. A canopy for use with recreational chairs to provide sun protection comprising two leg members of tubular construction, each leg member having a free end and an other end, said free end of each leg member terminating in a U-shaped slot formed by removal of a radial segment of said tubular leg member along a portion of its axial length so as to provide directly opposed concave segments adapted to matingly fit over the tubular frame of a chairback, said leg members being held apart with the leg slots in facing relationship by a connecting member of tubular construction, each of said leg members having connecting means at the other end thereof, said connecting means having a face adapted to rotatably contact an end face of said connecting member, a rod extending through said connecting member and having one end attached to a first leg member, the other rod end extending through the opposite end of the connecting member and through the other leg member, tensioning means attached to the rod end extending through said opposite end of the connecting member whereby tension can be applied to adjust the pressure between the rotatably contacting faces of said legs and said connecting member, a generally U-shaped frame member, the two ends of said frame member attached at the ends of said connecting member, said frame member extending outwardly from said connecting member in a generally planar configuration, the said legs held in spaced apart relationship, and said tensioning means being adapted to allow and to stop rotation of said connecting member whereby the canopy frame memer is readily adjustable in position.

2. The canopy according to claim 1 wherein said rod extending through said connecting member is attached to said first leg member by having the rod bent to extend into and be contained within said leg member.

3. The canopy according to claim 1 wherein said rod extending through said connecting member is attached to said first leg member by having the rod end threaded and extended through the wall, of said first leg member and mated with a tension handle.

4. The canopy according to claim 1 wherein said rod extending through said connecting member is attached to said first leg member by having the rod end threaded and extended through the wall, of said first leg member, and mated with a threaded lock nut.

5. The canopy according to claim 1 wherein said U-shaped frame member carries a sun screen material consisting of a cloth-like material.

6. The canopy of claim 5 wherein said cloth-like material is a plastic mesh material.

7. The canopy according to claim 5 wherein said cloth-like material carries an adhesive material along its edges whereby said adhesive material on contact will grip said canopy.

* * * * *